US005327731A

United States Patent [19]

Markiewicz

[11] Patent Number: 5,327,731

[45] Date of Patent: Jul. 12, 1994

[54] COLD STORAGE WAREHOUSE WITH CRYOGENIC TEST SITE

[76] Inventor: Stanley Markiewicz, 842 Shoreview Dr., Henderson, Nev. 89015

[21] Appl. No.: 10,599

[22] Filed: Jan. 12, 1993

[51] Int. Cl.[5] ..... F17C 1/00

[52] U.S. Cl. ..... 62/45.1; 62/322; 62/337; 454/231; 454/306

[58] Field of Search ..... 62/45.1, 322, 337, 467, 62/65; 454/231, 306

[56] References Cited

U.S. PATENT DOCUMENTS

| | | | |
|---|---|---|---|
| 2,862,369 | 12/1958 | Simons | 62/89 |
| 3,557,567 | 1/1971 | Brennan | 62/322 |
| 3,769,807 | 11/1973 | Foster | 62/63 |
| 3,868,827 | 3/1975 | Linhardt et al. | 62/401 |
| 3,992,891 | 11/1976 | Pocrnja | 62/53 |
| 4,063,432 | 12/1977 | Chaussy et al. | 62/419 |
| 4,077,226 | 3/1978 | Strong | 62/63 |
| 4,100,760 | 7/1978 | Cheney | 62/57 |
| 4,315,409 | 2/1982 | Prentice et al. | 62/401 |
| 4,367,630 | 1/1983 | Bernard et al. | 62/63 |
| 4,442,682 | 4/1984 | Sakata et al. | 62/401 |
| 4,599,871 | 7/1986 | Fredrixon | 62/378 |
| 4,989,417 | 2/1991 | Markiewicz | 62/441 |
| 5,029,447 | 7/1991 | Richard | 62/63 |
| 5,150,585 | 9/1992 | Markiewicz | 62/467 |

OTHER PUBLICATIONS

Cryogenics magazine, vol. 31, pp. 997-998 Nov., 1991.

Chicago Tribune, Business Section, pp. 1-2, "Beyond breakthroughs, edges gained by degrees", Sep. 6, 1992.

*Primary Examiner*—Ronald C. Capossela
*Attorney, Agent, or Firm*—John E. Roethel

[57] ABSTRACT

A cold storage warehouse is provided in the configuration of a generally circular or octagonal structure. The center of the cold storage warehouse is configured as a cryogenic test site with separate cubicles provided for low temperature research and development. A freezer area is located around the perimeter of the cryogenic test site for storing processed frozen food products. Around the perimeter of the freezer area is located another storage area for non-frozen processed cold food products. Air circulation vents are disposed through the center of cryogenic test site and around the perimeter of the cold storage warehouse to circulate cold air and provide for the transfer of heat to maintain each of the three areas at its desired temperature. Fans are used to circulate the air through the vents and the equipment necessary to operate and control the cold storage warehouse is located on the roof above the three temperature controlled areas. A series of superconductive storage transformers are provided around the central air circulation vent to store electrical current at low temperatures to minimize the loss of electrical current. This stored electrical current can be utilized for external uses either inside or outside the cold storage warehouse.

28 Claims, 5 Drawing Sheets

COLD STORAGE WAREHOUSE WITH CRYOGENIC TEST SITE

This invention relates to a cold storage warehouse, and more particularly to cold storage warehouse in which the central region of the warehouse functions as a cryogenic testing site and is surrounded by a freezing area and a moderately cold storage area.

BACKGROUND OF THE INVENTION

The delivery of frozen and cold foodstuffs to supermarkets requires most metropolitan areas to have one or more central distribution centers in which the foodstuffs are stored until shipment to the supermarkets for purchase by the consumer.

Cold storage warehouses of many different configurations have been proposed over the years. In U.S. Pat. No. 4,989,417, the present inventor discloses a warehouse arrangement comprising a cluster of inner cells for receiving and storing processed frozen food products at extremely low temperatures. The inner cells are surrounded by outer cells for receiving and storing processed refrigerated food products at more moderate, yet still cold, temperatures. The outer cells function to insulate the inner cells from cooling temperature losses. Both the inner and outer cells are cooled by removing heat from the rising warm air by driving the warm air through a combination evaporator and fan units through a closed loop finned duct system located beneath the ceilings of each of the inner and outer cells. The disclosure of this U.S. Pat. No. 4,989,417 is incorporated herein by this reference.

U.S. Pat. No. 5,150,585 also to the present inventor discloses an energy recovery system for use in a cold storage warehouse. A refrigeration apparatus coacts with energy recovery units having turbines coupled to electromotive generators. The activation of the generators to produce electricity is achieved by utilizing surplus energy available from the operation of the refrigeration apparatus. The surplus energy comes primarily from the kinetic energy of the fluids, vapors and gases flowing through the conduit systems forming circuits through which the refrigerant is circulated during the refrigeration cycle of the refrigeration apparatus.

The present invention expands the concepts contained in these two earlier patents to include a cryogenic test site area on the interior of a specially arranged cold storage warehouse. This cryogenic test site is provided on the interior of the cold storage warehouse and offers a location in which low temperature research and development can be conducted without detracting from the operation and efficiency of the working areas of the cold storage warehouse. The cryogenic test site is easily accessible to scientists and engineers who wish to conduct research and development in a low temperature environment. The cryogenic test site is located such as to not interfere with the storage of processed refrigerated food products and the receipt, storage and delivery of these food products can go on without interrupting the research and development being conducted in the cryogenic test site.

It is an object of the present invention to provide a cryogenic test site as a functional part of a cold storage warehouse.

It is a feature of the present invention to locate the cryogenic test site on the interior of a generally circular or octagonal structure and both freezer and cold storage warehouse areas are located around the perimeter of the cryogenic test site.

It is an advantage of the present invention that a convenient location and arrangement for a cryogenic test site can be provided in conjunction with a cold storage warehouse. The cryogenic test site is located so that research and development being conducted in the cryogenic test site does not interfere with the normal operation of the rest of the cold storage warehouse, while at the same time taking advantage of the operating environment of the cold storage warehouse to minimize the amount of energy and insulation that would otherwise be necessary to maintain a cryogenic test site at its needed operating conditions.

Other objects, features and advantages of the present invention will become apparent from a consideration of the following detailed description.

SUMMARY OF THE INVENTION

A cold storage warehouse is provided in the configuration of a generally circular or octagonal structure. The center of the cold storage warehouse is configured as a cryogenic test site with separate cubicles provided for low temperature research and development. A freezer area is located around the perimeter of the cryogenic test site for storing processed frozen food products. Around the perimeter of the freezer area is located another storage area for non-frozen processed cold food products. Air circulation vents are disposed through the center of cryogenic test site and around the perimeter of the cold storage warehouse to circulate cold air and provide for the transfer of heat to maintain each of the three areas at its desired temperature. Fans are used to circulate the air through the vents and the equipment necessary to operate and control the cold storage warehouse is located on the roof above the three temperature controlled areas. A series of superconductive storage transformers are provided around the central air circulation vent to store electrical current at low temperatures to minimize the loss of electrical current. This stored electrical current can be utilized for external uses either inside or outside the cold storage warehouse.

DETAILED DESCRIPTION OF THE PREFERRED EMBODIMENTS

The disclosures of U.S. Pat. No. 4,989,417 and U.S. Pat. No. 5,150,417 are incorporated herein by this reference thereto.

Figure 1:
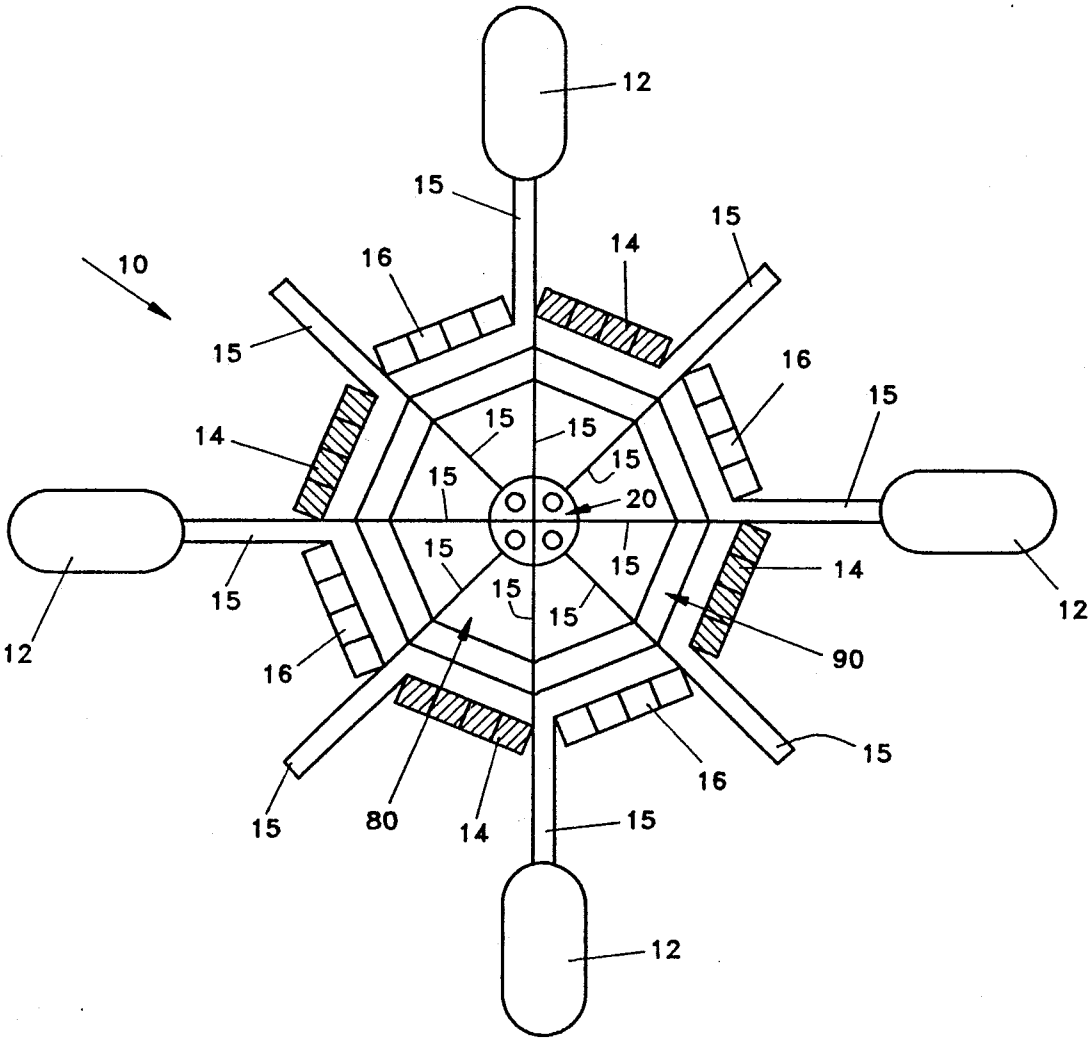
FIG. 1 shows a top cross-sectional view of the cold storage warehouse of the present invention.

The cold storage warehouse of the present invention is shown generally at 10 in FIG. 1. In the preferred embodiment, the cold storage warehouse 10 is configured in an octagonal shape when viewed from above, although persons skilled in the art would recognize that other configurations such as round, square or other polygonal shapes could be adapted as a cold storage warehouse without departing from the spirit of the present invention.

A plurality of food processing plants 12 are disposed on the outer extremities of the cold storage warehouse 10 and the food processed in each food processing plant 12 can be transported for storage to the holding areas of the cold storage warehouse 10. Alternating along each side of the cold storage warehouse 10 are storage shipping docks 14 and food processing shipping docks 16 to allow the ingress and egress of processed foods to and from the cold storage warehouse 10 by truck or other suitable modes of transportation. A series of interconnected insulated walls 15 form the remainder of the outside structure of the cold storage warehouse 10, as well as provide physical separation between the various areas of the cold storage warehouse 10. In the preferred embodiment of the present invention, the insulated walls can be double panel walls with a vacuum space in between the panels, similar to the manner that thermos or vacuum bottles are constructed. Alternatively, any other conventional insulated wall structure can be used.

Toward the interior side of the storage shipping docks 14 and food processing shipping docks 16, there is provided a storage cooler 90 that surrounds the rest of the interior of the cold storage warehouse 10. This storage cooler 90 provides appropriate storage space for processed foods that do not need to be kept in a frozen state. In the preferred embodiment of the present invention, the typical operating condition for the storage cooler 90 is generally between 30° F. and 35° F.

To the inside of the storage cooler 90, there is next provided a storage holding freezer 80 for storing processed foods that need to be kept frozen. In the preferred embodiment of the present invention, the typical operating condition for the storage holding freezer 80 is between generally −25° F. and −15° F. Reference is made to U.S. Pat. No. 4,989,417 for disclosure relating to a cold storage warehouse in which a storage holding freezer 80 is surrounded by a storage cooler 90 and maintained in temperature controlled conditions by circulating air.

Finally, the central area of the cold storage warehouse 10 comprises a cryogenic test site 20, in which research and development at low temperatures can be conducted. In the preferred embodiment of the present invention, the operating condition for the cryogenic working areas 50 is approximately −50° and the operating condition for the storage transformers 68 is approximately −250° F.

As shown in FIG. 1, the octagonal configuration of the cold storage warehouse 10 results in a structure that has eight separate storage holding freezers 80 and eight separate storage coolers 90. The configuration of the cryogenic test site 20 results in a structure that has four separate compartments. As discussed below, the cold storage warehouse 10 also can be divided vertically into floors. This entire arrangement provides great flexibility for arranging and storing processed foods and for providing separate and distinct research and development facilities.

Figure 2:
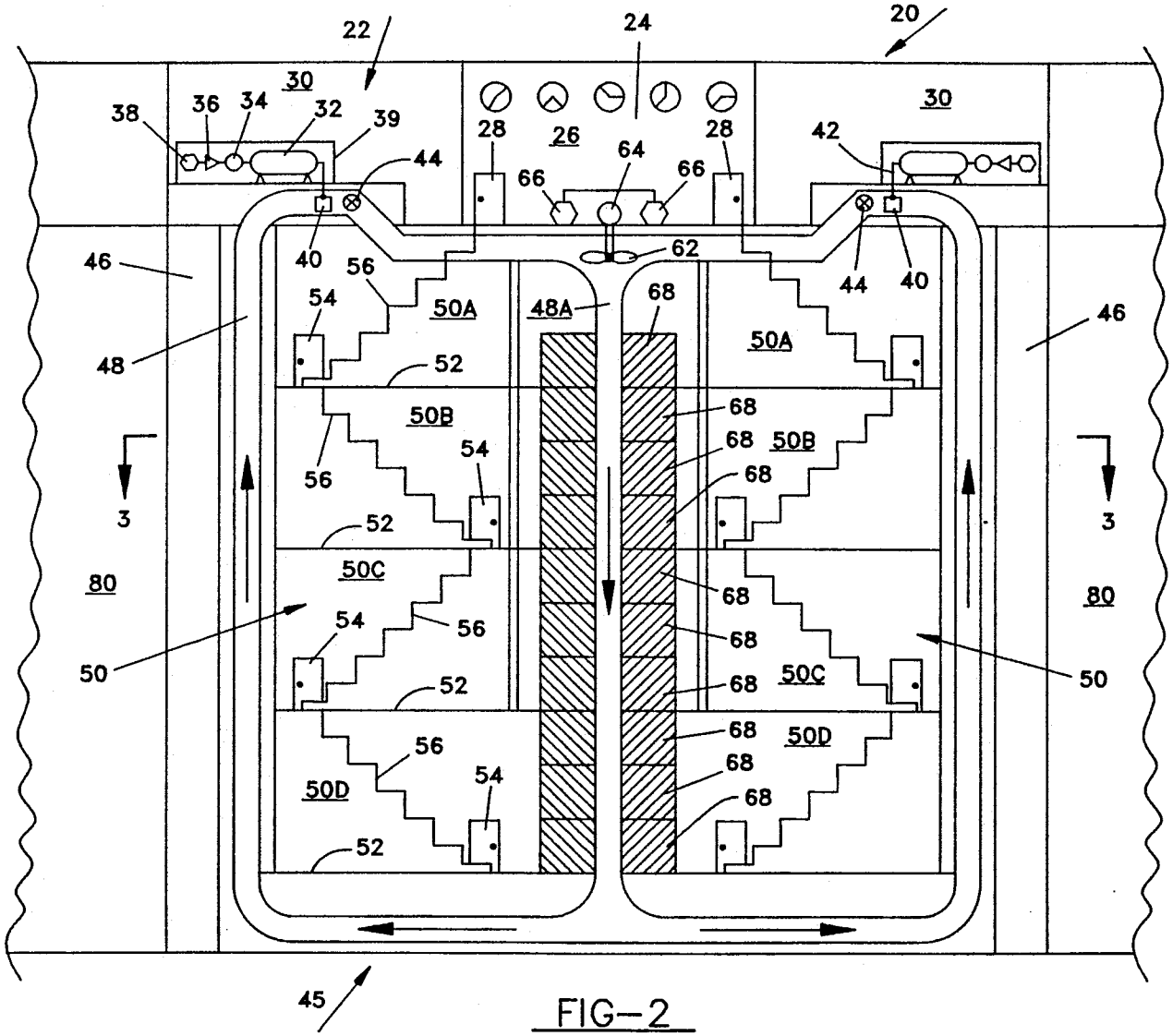
FIG. 2 shows a side cross-sectional view taken along line 2—2 of FIG. 3 of the cryogenic test site portion of the cold storage warehouse of the present invention.
Figure 3:
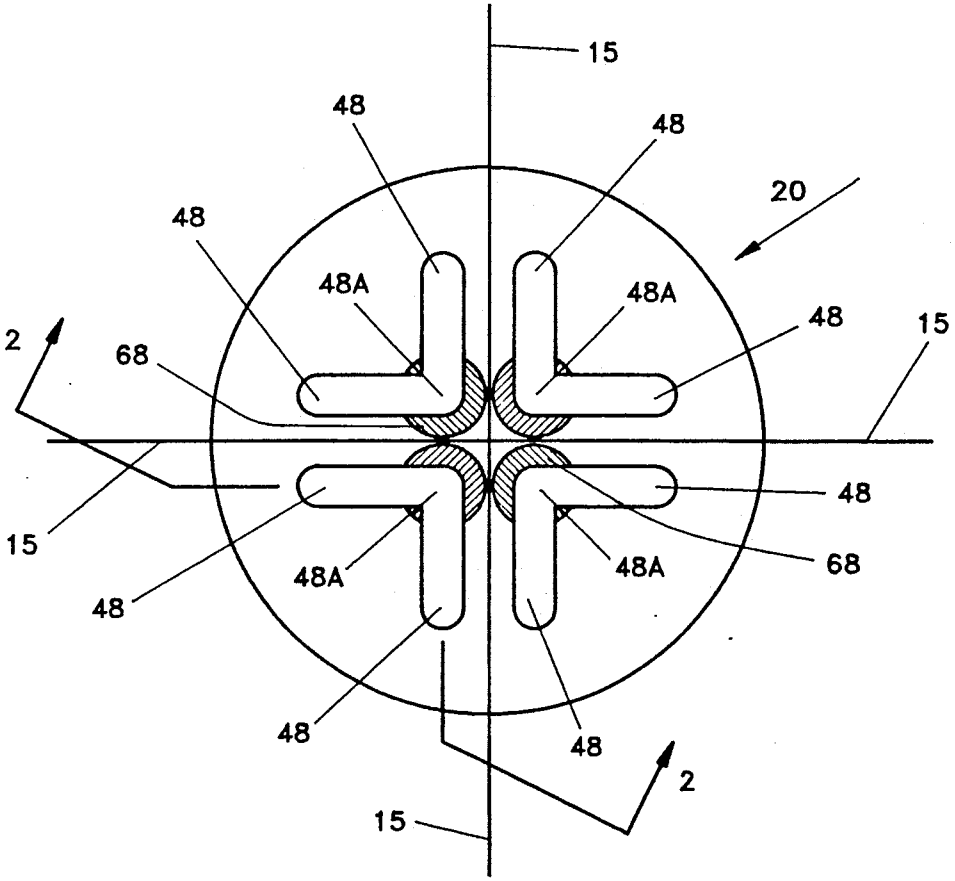
FIG. 3 shows a top sectional view taken along line 3—3 of FIG. 2 of the cryogenic test site portion of the cold storage warehouse of the present invention.

The cryogenic test site 20 is shown in further detail in FIGS. 2 and 3. A lower section 45 provides the working research and development area divided both horizontally by floors and vertically by walls into a plurality of separate compartments and an upper section 22 located on the roof above the lower section 45 providing space for the control room 24 and the various compressor rooms 30 which house the equipment necessary to operate and maintain the cold storage warehouse 10 at the required temperatures.

The control room 24 includes a voltage control grid 26 and access doors 28 which lead into the lower section 45 to provide access to the control room 24 from the research and development areas. In the preferred embodiment of the present invention, the control room 24 is located on the roof at the very center of the octagonly shaped cold storage warehouse 10. The central control room 24 is surrounded by four compressor rooms 30.

With reference to FIG. 3, the effect of the intersecting insulated walls 15 creates four separate lower sections 45, each with its associated compressor room 30 located on the roof above each lower section 45.

With reference again to FIG. 2, one of the four lower sections 45 is shown. Each lower section 45 comprises a cryogenic working area 50 completely surrounded by a closed loop air circulation vent 48 through which air circulates to maintain the low temperature required for the cryogenic working area 50. A vacuum chamber 46 insulates the lower section 45 from the adjoining storage holding freezer 80.

Each cryogenic working area 50 can be further separated horizontally into a first floor working area 50A, a second floor working area 50B, a third floor working area 50C and a fourth floor working area 50D. This separation is effected by grated floors 52 and each horizontally separated working area is connected by doors 54 and stairs 56. Suitable equipment (not shown) can be provided in each working area to allow scientists and engineers to conduct research and development at the low temperatures existing in these working areas.

The low temperatures in the cryogenic working area 50 are achieved by circulating air around the cryogenic working area 50. The air circulation vent 48 is formed in a continuous loop around each cryogenic working area 50. Each continuous loop shares a common central air circulation vent 48A in the very center of the lower section 45. The movement of the air is effected by an air circulation fan 62 which can be positioned in the ceiling area of the lower section 45. The superconductive electric motor 64 and superconductive voltage generator 66 that powers the air circulation fan 62 can be located in the floor area of the control room 24 to protect these elements from the cold air in the air circulation vent 48. The air circulation fan 62 can be connected to the superconductive electric motor 64 by an insulated shaft, or, in the preferred embodiment, a magnetic coupling can connect the superconductive electric motor 64 to the air circulation fan 62.

In order to improve the efficiency of the voltage generator 66 and the electric motor 64, in the preferred embodiment, a superconductive voltage generator 66 and a superconductive electric motor 64 are utilized. Any suitable superconductive voltage generator 66 and superconductive electric motor 64 can be used, such as the superconductive system developed by American Superconductive Corporation, 149 Grove Street, Watertown, Mass. 02172 and described at pages 997–998 of *Cryogenics* magazine, Vol. 31, November, 1991.

Disposed along the sides of and surrounding the central air circulation vent 48A are a series of superconductive storage transformers 68. Each storage transformer 68 includes ceramic or crystal coils submerged in liquid nitrogen. Any suitable superconductive storage transformer 68 can be used such as the "tube within a tube" design for superconductive wire described in *Popular Science* magazine at page 18 of the December, 1992 issue. The superconductive voltage generators 66 send current to superconductive storage transformers 68 where the current can be stored at low temperatures with a resulting minimal amount of energy loss. The electrical current stored in these superconductive storage transformers 68 can be accessed through the voltage control grid 24 and sent to external uses inside or outside the cold storage warehouse 10.

Figure 4:
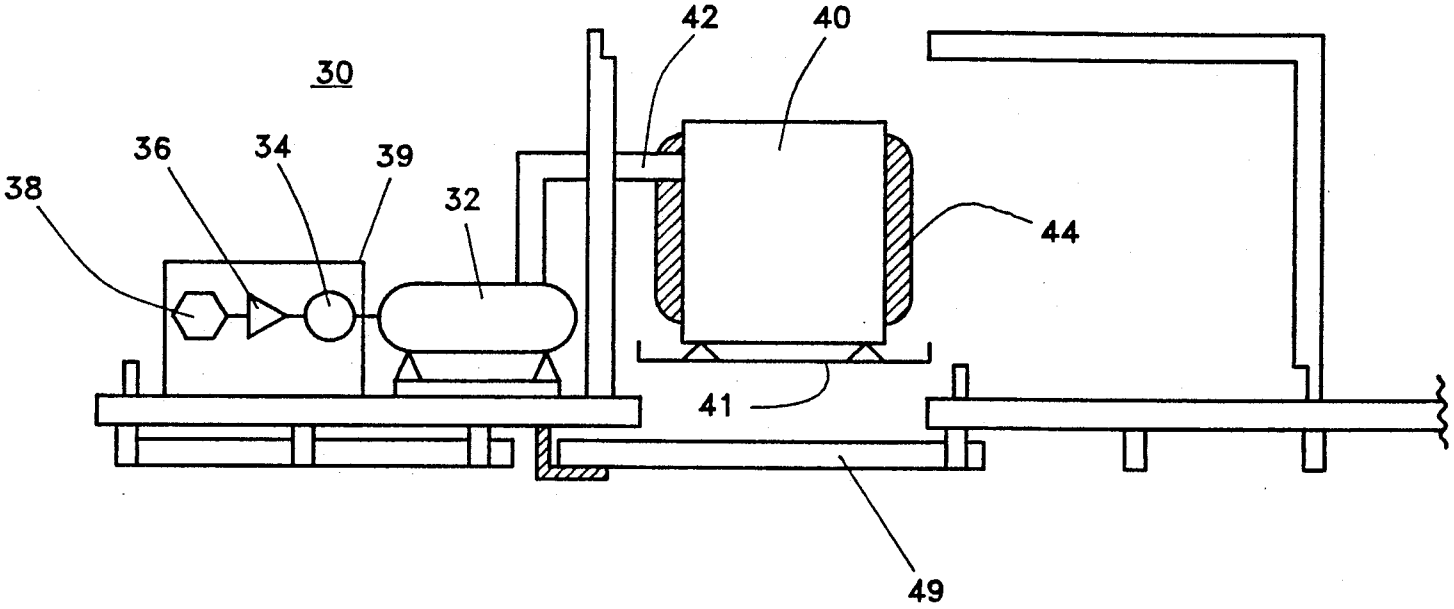
FIG. 4 shows a side view of the operating equipment located on the roof of the cold storage warehouse of the present invention.

As shown in detail in FIG. 4, each compressor room 30 is provided with a refrigeration compressor 32 which is connected to a superconductive electric motor 34, an energy recovery superconductive turbine 36 and a voltage generator 38, all located within a flux cage 39. The refrigeration compressor 32 is joined by refrigeration tubing 42 to a refrigeration evaporator 40 and its associated high velocity air circulating fan 44. Reference is made to U.S. Pat. No. 5,150,585 for further details of the operation of the refrigeration compressor 32 and its related equipment located in the compressor room 30.

In order to prevent water dripping into the air circulation vent 48, the refrigeration evaporator 40 and its associated air circulating fan are located in a raised chamber 43 adjacent the air circulation vent 48. During the defrost cycle of the operation of the cold storage warehouse 10, a panel cover 49 is used to close the floor opening. When defrosting is completed, the panel cover 49 can be removed or slid to the side and the refrigeration reactivated. A defrost drip pan 41 is positioned below the refrigeration evaporator 40 to collect any water that may drip from the refrigeration evaporator during defrosting.

Figure 5:
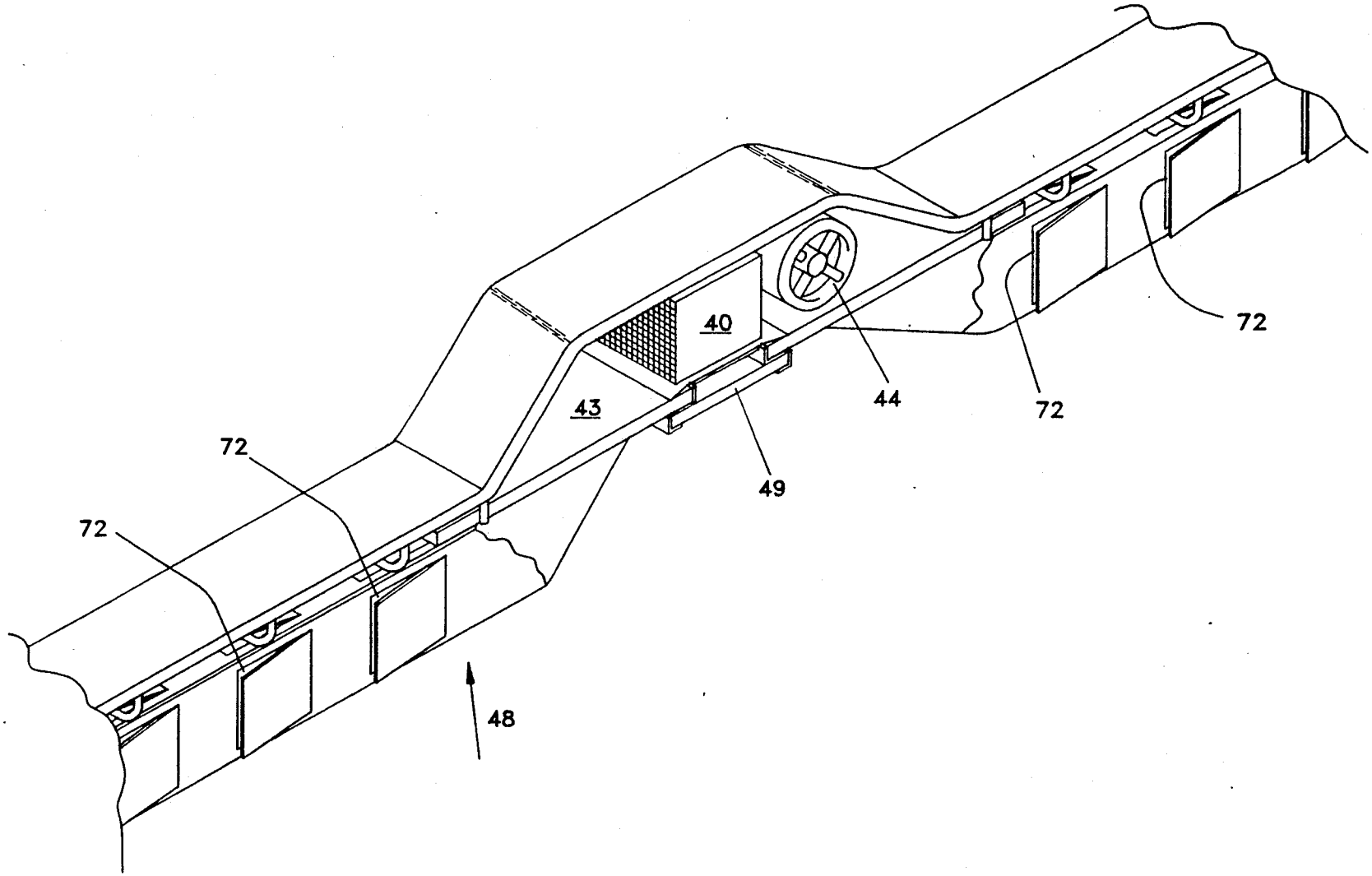
FIG. 5 shows an isometric view, partly in section, of the air circulation vent used in the cold storage warehouse of the present invention.

The details of the air circulation vent 48 are shown in FIG. 5. Each air circulation vent 48 is a generally rectangular duct and is provided with a plurality of air circulating duct openings 72 on each side of the duct to allow communication of the air inside the duct with the air in the adjoining lower section 45.

Various modifications and additions may be made and will be apparent to those skilled in the art. The cryogenic test site portion of the cold storage warehouse may be constructed as a separate structure without the adjoining storage holding freezer or the storage cooler. For example, the cryogenic test site can be built in association with an electric, hydroelectric or atomic power plant.

While the invention has been illustrated with respect to several specific embodiments thereof, these embodiments should be considered as illustrative rather than limiting. Accordingly, the invention should not be limited by the foregoing description, but rather should be defined only by the following claims.

What is claimed is:

1. A cold storage warehouse comprising:

a) a central cryogenic test site in which subzero research and development may be conducted comprising:

1) an upper section including a control room in which are provided a voltage generator and an electric motor and at least one compressor room adjoining the control room and in which is provided at least a refrigeration compressor, 2) a lower section including at least one cryogenic working area and a closed loop air circulation vent surrounding the cryogenic working area, the closed loop air circulation vent further including an air circulation fan, 3) the refrigeration compressor being operatively connected by a refrigeration tubing to a refrigeration evaporator and a high circulation fan mounted adjacent to the closed loop air circulation vent, and 4) at least one superconductive storage transformer located adjacent the air circulation vent adapted to store at low temperatures electrical current from the voltage generator, b) at least one storage holding freezer disposed around the central cryogenic test site, c) at least one storage cooler disposed around the storage holding freezer, d) at least one shipping dock located adjacent the storage cooler, and e) at least one food processing plant associated with the shipping dock.

2. The cold storage warehouse of claim 1 wherein the control room includes a voltage control grid connected to the superconductive storage transformer to provide current to the transformer and to withdraw current from the transformer for delivery to external current uses.

3. The cold storage warehouse of claim 2 wherein the voltage generator is connected to a superconductive electric motor for operating the air circulation fan in the air circulation vent.

4. The cold storage warehouse of claim 3 wherein the air circulation fan is operatively connected to the superconductive electric motor by a magnetic coupling.

5. The cold storage warehouse of claim 1 comprising:

a) at least one refrigeration evaporator and an associated air circulating fan disposed adjacent to the air circulation vent for cooling air circulating in the air circulation vent, and b) wherein the compressor room further includes a superconductive electric motor, a superconductive energy recovery turbine and a superconductive voltage generator connected to the refrigeration evaporator.

6. The cold storage warehouse of claim 1 wherein the air circulation vent has a central air vent portion disposed generally in the center of the cryogenic working area and the air circulation vent has a first closed loop branch and a second closed loop branch which share the common central air vent portion and surround the cryogenic working area.

7. The cold storage warehouse of claim 1 wherein the air circulation vent is a generally rectangular duct having a plurality of vent openings to allow cooled air to communicate with the interior of the cryogenic working area.

8. A cold storage warehouse laid out in a generally octagonal configuration comprising:

a) a central cryogenic test site in which subzero research and development may be conducted comprising a plurality of vertically separated areas divided from one another by insulated walls, each vertically separated area comprising:

1) an upper section including a control room in which are provided a voltage generator and an electric motor and at least one compressor room adjoining the control room and in which is provided at least a refrigeration compressor, 2) a lower section including a plurality of cryogenic working areas separated horizontally from one another by grated flooring,
3) each cryogenic working area being surrounded by a closed loop air circulation vent with an air circulation fan positioned therein,
4) the refrigeration compressor being operatively connected by a refrigeration tubing to a refrigeration evaporator and a high circulation fan mounted adjacent to the closed loop air circulation vent, and
5) at least one superconductive storage transformer located adjacent each air circulation vent adapted to store at low temperatures electrical current from the voltage generator, b) a plurality of vertically separated storage holding freezers disposed around the central cryogenic test site,
c) a plurality of vertically separated storage coolers disposed around the storage holding freezers,
d) a plurality of vertically separated shipping docks located adjacent the storage coolers, and
e) a food processing plant associated with each of the shipping docks.

9. The cold storage warehouse of claim 8 wherein the control room includes a voltage control grid connected to each of the superconductive storage transformers to provide current to the transformers and to withdraw current from the transformers for delivery to external current uses.

10. The cold storage warehouse of claim 9 wherein the voltage generator is connected to a superconductive electric motor for operating each of the air circulation fans in the air circulation vents.

11. The cold storage warehouse of claim 10 wherein each of the air circulation fans are operatively connected to the superconductive electric motor by a magnetic coupling.

12. The cold storage warehouse of claim 9
wherein the compressor room further includes a superconductive electric motor, a superconductive energy recovery turbine and a superconductive voltage generator connected to the refrigeration evaporator.

13. The cold storage warehouse of claim 9 wherein each of the air circulation vents has a central air vent portion disposed generally in the center of each cryogenic working area and each of the air circulation vents has a first closed loop branch and a second closed loop branch which share the common central air vent portion and surround the cryogenic working area.

14. The cold storage warehouse of claim 13 wherein the air circulation vent is a generally rectangular duct having a plurality of vent openings to allow cooled air to communicate with the interior of the cryogenic working area.

15. A cryogenic test site in which subzero research and development may be conducted comprising:
a) an upper section including a control room in which are provided a voltage generator and an electric motor and at least one compressor room adjoining the control room and in which is provided at least a refrigeration compressor,
b) a lower section including at least one cryogenic working area and a closed loop air circulation vent surrounding the cryogenic working area, the closed loop air circulation vent further including an air circulation fan,
c) the refrigeration compressor being operatively connected by a refrigeration tubing to a refrigeration evaporator and a high circulation fan mounted adjacent to the closed loop air circulation
d) at least one superconductive storage transformer located adjacent the air circulation vent adapted to store at low temperatures electrical current from the voltage generator.

16. The cryogenic test site of claim 15 wherein the control room includes a voltage control grid connected to the superconductive storage transformer to provide current to the transformer and to withdraw current form the transformer for delivery to external current uses.

17. The cryogenic test site of claim 16 wherein the voltage generator is connected to a superconductive electric motor for operating the air circulation fan in the air circulation vent.

18. The cryogenic test site of claim 17 wherein the air circulation fan is operatively connected to the superconductive electric motor by a magnetic coupling.

19. The cryogenic test site of claim 15
wherein the compressor room further includes a superconductive electric motor, a superconductive energy recovery turbine and a superconductive voltage generator connected to the refrigeration evaporator.

20. The cryogenic test site of claim 15 wherein the air circulation vent has a central air vent portion disposed generally in the center of the cryogenic working area and the air circulation vent has a first closed loop branch and a second closed loop branch which share the common central air vent portion and surround the cryogenic working area.

21. The cryogenic test site of claim 15 wherein the air circulation vent is a generally rectangular duct having a plurality of vent openings to allow cooled air to communicate with the interior of the cryogenic working area.

22. A cryogenic test site in which subzero research and development may be conducted, the cryogenic test site laid out in a generally octagonal configuration and having a plurality of vertically separated areas divided from one another by insulated walls, each vertically separated area comprising:
a) an upper section including a control room in which are provided a voltage generator and an electric motor and at least one compressor room adjoining the control room and in which is provided at least a refrigeration compressor,
b) a lower section including a plurality of cryogenic working areas separated horizontally from one another by grated flooring,
c) each cryogenic working area being surrounded by a closed loop air circulation vent with an air circulation fan positioned therein,
c) the refrigeration compressor being operatively connected by a refrigeration tubing to a refrigeration evaporator and a high circulation fan mounted adjacent to the closed loop air circulation vent, and
d) at least one superconductive storage transformer located adjacent the air circulation vent adapted to store at low temperatures electrical current from the voltage generator.

23. The cryogenic test site of claim 22 wherein the control room includes a voltage control grid connected to each of the superconductive storage transformers to provide current to the transformers and to withdraw current form the transformers for delivery to external current uses.

24. The cryogenic test site of claim 23 wherein the voltage generator is connected to a superconductive electric motor for operating each of the air circulation fans in the air circulation vents.

25. The cryogenic test site of claim 24 wherein each of the air circulation fans is operatively connected to the superconductive electric motor by a magnetic coupling.

26. The cryogenic test site of claim 22 wherein the compressor room further includes a superconductive electric motor, a superconductive energy recovery turbine and a superconductive voltage generator connected to the refrigeration evaporator.

27. The cryogenic test site of claim 22 wherein each of the air circulation vents has a central air vent portion disposed generally in the center of each of the cryogenic working areas and each of the air circulation vents has a first closed loop branch and a second closed loop branch which share the common central air vent portion and surround the cryogenic working area.

28. The cryogenic test site of claim 22 wherein each of the air circulation vents is a generally rectangular duct having a plurality of vent openings to allow cooled air to communicate with the interior of the cryogenic working area.

* * * * *